US005440994A

United States Patent [19]

Alexander

[11] Patent Number: 5,440,994

[45] Date of Patent: Aug. 15, 1995

[54] ARMOR PENETRATING BULLET

[75] Inventor: William Alexander, Stafford, England

[73] Assignee: Privada Corporation, New York, N.Y.

[21] Appl. No.: 186,878

[22] Filed: Jan. 25, 1994

[51] Int. Cl.[6] ..... F42B 12/02

[52] U.S. Cl. ..... 102/439; 102/506; 102/516; 102/517; 102/703

[58] Field of Search ..... 102/439, 474, 506–510, 102/514–519, 489, 703

[56] References Cited

U.S. PATENT DOCUMENTS

| | | | |
|---|---|---|---|
| 45,474 | 12/1864 | Cleu | 102/506 |
| 3,143,966 | 8/1964 | Burns, Jr. et al. | 102/507 |
| 3,637,449 | 7/1972 | Reech, Jr. | 102/703 |
| 3,894,492 | 7/1975 | Barr et al. | 102/519 |
| 3,972,286 | 8/1976 | Canon | 102/507 |
| 4,108,073 | 8/1978 | Davis | 102/518 |
| 4,774,889 | 10/1988 | Wallow | 102/517 |
| 4,879,953 | 11/1989 | Carter | 102/507 |
| 4,913,054 | 4/1990 | Petersen | 102/506 |

*Primary Examiner*—Harold J. Tudor
*Attorney, Agent, or Firm*—White & Case

[57] ABSTRACT

The invention relates to armor penetrating bullets suitable for use with a wide range of weaponry from automatic shoulder arms to hand guns. The invention provides a bullet which comprises a cartridge containing a propellant charge, a casing attached to the cartridge, and a plurality of individual flechettes contained in the casing. The bullet provides high penetration through stiff materials such as body armor made of interwoven fibers but the individual flechettes are most easily stopped in softer material.

12 Claims, 3 Drawing Sheets

ARMOR PENETRATING BULLET

BACKGROUND OF THE INVENTION

1. Field of the Invention

This invention relates generally to munitions and more particularly to a bullet which can penetrate body armor and which is suitable for use with a wide range of weaponry, but principally small arms ranging from automatic shoulder arms to hand guns. Ammunition used in peace time law enforcement has certain distinct requirements compared to that required for war time use. It is desirable that ammunition used in populated areas must be both accurate and effective on only the single, intended target. That is, a bullet should not pass through the target to a secondary unintended individual.

2. Description of the Prior Art

Many armor-piercing bullets known in the prior art will easily penetrate body armor, but rely on non-deformation for this performance. Such a design cannot transfer energy effectively, and shows minimum wounding effects with almost guaranteed shoot-through.

The frangible bullets known in the art use the opposite effect and consequently show reverse characteristics. The frangible bullet is designed to break up easily. This provides good energy transfer and wounding capability while reducing the chance of shoot-through. However, body armor or even, in some cases, heavy clothing, will defeat a frangible bullet as its design allows it to break up easily into particles with good energy transfer capabilities, but low penetrative power.

Known frangible bullets are disclosed in U.S. Pat. No. 3,911,820, and No. 3,972,286. The former patent discloses a bullet comprising a hollow missile casing which is attached to a cartridge carrying a propellant charge, wherein the casing holds a plurality of heavy spherical metal particles and a viscous liquid. The casing also has a blunt or rounded tip which forms a frangible seal on the casing. It is stated that such a bullet is resistant to deformation during firing, but the frangible seal breaks upon impact with a target, thereby releasing the contents of the case into the target. The nature of the conical spread of particles from the bullet on penetration into the target is said to be dependent on the viscosity of fluid. Another characteristic of the bullet disclosed is that it does not ricochet off a target which would otherwise occur with previously known small arms projectiles.

U.S. Pat. No. 3,972,286, discloses a bullet which comprises a hollow, open-ended casing which is attached to a cartridge carrying a propellant charge wherein the casing is substantially cylindrical and thereby defines the caliber of the bullet. The casing has a closed base end and encloses a plurality of spherical, shot particles which are freely separable from each other upon impact with a target. The casing further comprises a separate tip which extends into and frangibly seals the open end of the casing.

An integral bullet is constituted which is resistant to deformation or destruction during firing in a rifle bore, but upon impact with a target, the frangible seal breaks, thereby releasing the short particles which scatter separately into the target. It is again stated that an advantage of this particular construction is that the bullet is readily broken upon impact even at low angles, and the bullet will not ricochet off the target. A function of the cap when placed on the open end of the bullet casing is to seal the multiple shot projectiles within the bullet. Also, in order to prevent a very wide spray of shot when the bullet impacts the target, a viscous fluid is required to fill the cavity within the casing of the bullet. This adds an additional incumbrance on a manufacturer preparing the bullets and may also affect the longevity of the bullet given the possibility of fluid leakage from the casing.

These known bullets are said to transfer their energy very rapidly to the target and therefore it is said that they have greater stopping power. In order to achieve this effect, typically some 300 spherical sub-projectiles are used within one bullet casing. It is apparent that such known bullets require many separate components, all of which require individual manufacture prior to assembly of a final integral bullet. In addition, other prior art bullets which can effectively penetrate body armor often shoot entirely through the body, and the armor and thus can cause injury to an unintended target.

SUMMARY OF THE INVENTION

The present invention provides a bullet which mitigates the drawbacks of the prior art. According to the invention, there is provided a bullet which comprises a cartridge carrying a propellant charge, a hollow cylindrical casing attached to the cartridge which is constructed of frangible material and is closed at one end and has an annular open nose at the other end, a plurality of flechettes housed within the casing, and an elastomeric nose cap filling the annular open nose of the casing.

In operation, upon firing, the casing travels as a single unit with the flechettes contained within the casing during flight; the stabilization of the complete casing being achieved by the spin imparted by the weapon's rifling. In this way, the casing behaves like a normal bullet casing and is aimed at the target in the same way. However, upon striking a sufficiently rigid target, the casing will deform and rupture due to the internal forces and hoop stress generated by the elastomeric nose cap, thus releasing the flechettes.

The casing attached to the cartridge is of sufficient length to prevent protrusion of the flechettes beyond the annular open nose, and the frontal section of the casing is reduced in diameter to create a ballistic ogive. The annular open nose is filled with an elastomeric cap. The casing is constructed of frangible material which deforms upon impact with the armor to allow the proper release of the flechettes into the armor.

The flechettes are arranged in the casing with the tip of each flechette pointing towards the annular open nose. The flechettes are not individually spin-stabilized in the same manner as the complete bullet. Instead, they are in a state of semi-stability when released due to their design and the fact that during flight they are rotating about the bullet axis rather than spinning about their own axes. The flechettes possess an individual, forward velocity with the stability in flight being provided by their design and corresponding length to diameter ratio.

The length to diameter ratio gives each flechette a very high energy level per cross-sectional area. This parameter means that an individual flechette has an immense penetrating capability, provided the flechette does not tumble. When the casing strikes a sufficiently hard target, such as armor, the casing and elastomeric nose cap rupture and release the flechettes with the armor. While the flechette is travelling through the armor, the armor maintains a constant force on the shank of the flechette to prevent it from tumbling. This enables the flechette to penetrate armor with only a slight divergence from the original line of flight.

The behavior of the flechette changes drastically when it passes through the armor into soft media, such as flesh. Here, the flechette destabilizes very rapidly and begins to tumble. In tumbling, the flechette will diverge significantly from the line of flight which generates two forms of wounding effect, an extended crush zone produced by the temporary and permanent cavity formation and induced blood loss caused by the lacerations created by the flechette as it tumbles. Further, the energy of each flechette will be distributed over the much greater area of the flechette's side during tumbling. This produces a low energy per cross-sectional area and consequently rapidly pumps energy into the target and restricts overpenetration.

The annular open nose of the casing is filled with an elastomeric cap. The nose cap serves three main functions. It provides a suitable shape for feeding in a variety of weapons. It also generates hydrodynamic pressure within the casing during impact to ensure that the casing does not collapse inwardly when it strikes the armor, thus ensuring the reliable release of the flechettes. Finally, the nose cap serves to stabilize the position of the flechettes within the casing during flight. This ensures ballistic integrity of the overall casing and, hence, results in consistent accuracy. The nose cap also isolates the components within the casing from the environment to provide a good shelf life under all normal conditions.

An overall summary of operation is that hard medias are penetrated with little energy loss per unit distance travelled, while energy is dissipated quickly into soft media by means of severe material damage. The result is that the bullet can defeat hard medias, but will not shoot through soft media.

Of particular interest is the bullet's interaction with the woven types of body armors, such as para-aramids or the high density polyethylenes. These systems rely on the very high tensile strength of the individual fibers to defeat impacts from projectiles. A traditional bullet, when fired into these materials, acts directly on the fibers generating a tensile force, which must exceed the failure limit of the fiber if the armor is to be defeated. In comparison, the bullet of the instant invention does not interact directly with the fibers, but releases the flechettes into the material. The flechettes do not attempt to overcome the high tensile fibre strength, but instead attack the weakest point of the armor, that is, the gaps between the fibers of the weave. By finding the gaps, the flechettes will penetrate many layers of the woven fabrics with minimal energy loss. The fibers of the material also serve to stabilize the flechettes by restricting the divergence on the shank. The aramid-type fabrics are excellent in this respect owing to their strength while high density polyethelenes also have a low coefficient of friction further enhancing the penetration abilities.

DETAILED DESCRIPTION OF THE INVENTION

Figure 1:
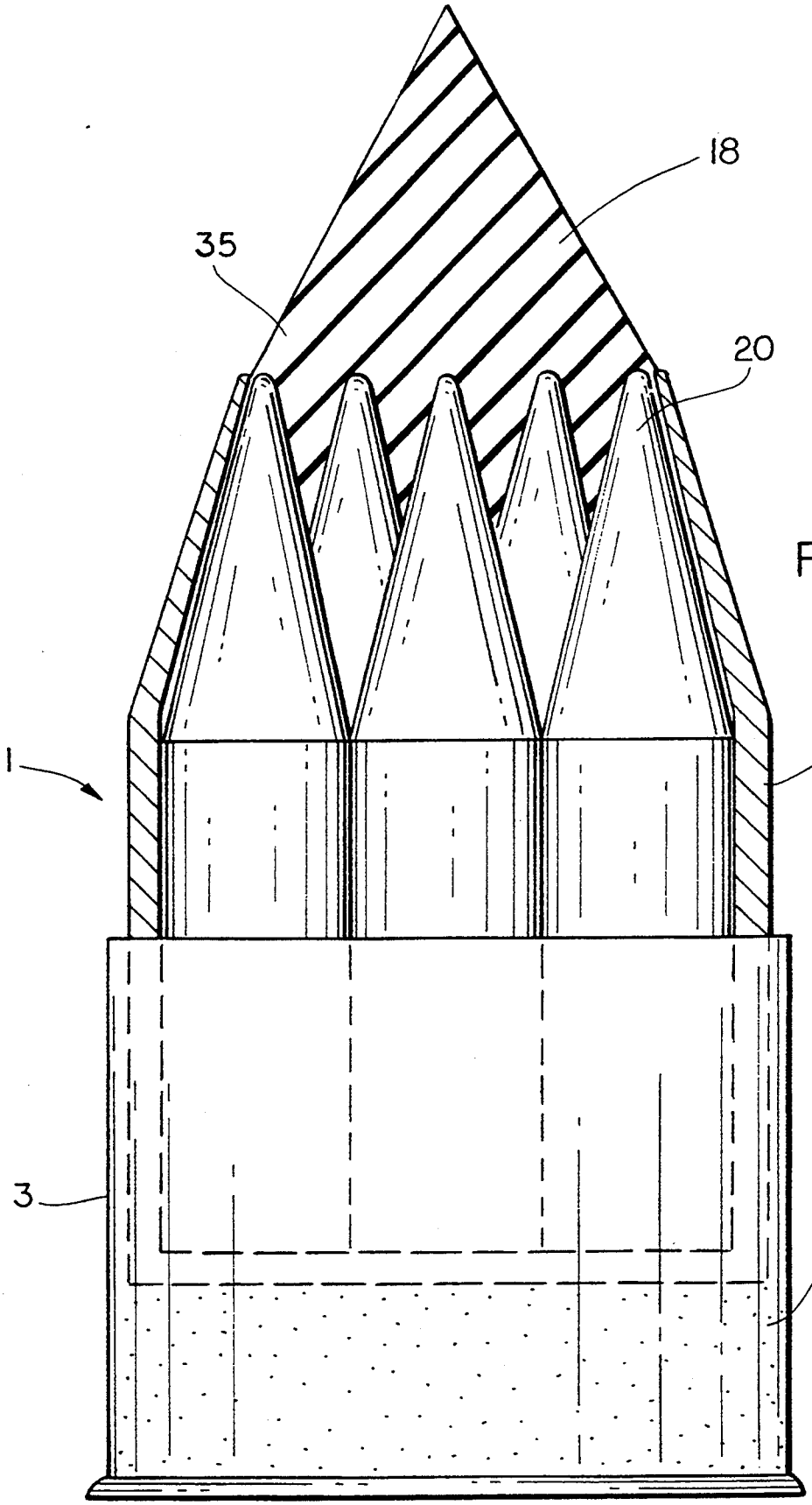
FIG. 1 is a side elevation partial cross-sectional view of the bullet according to the invention.

Referring to FIG. 1, the bullet 1 according to the invention comprises a cartridge 3 containing a propellant 5, a casing 8 attached to the cartridge which is closed at one end and has an annular open nose 18 at the other end, flechettes 20 housed inside the casing with the tip of each flechette 20 pointing towards open nose 18, and an elastomeric nose cap 35 filling annular open nose 18.

Figure 3:
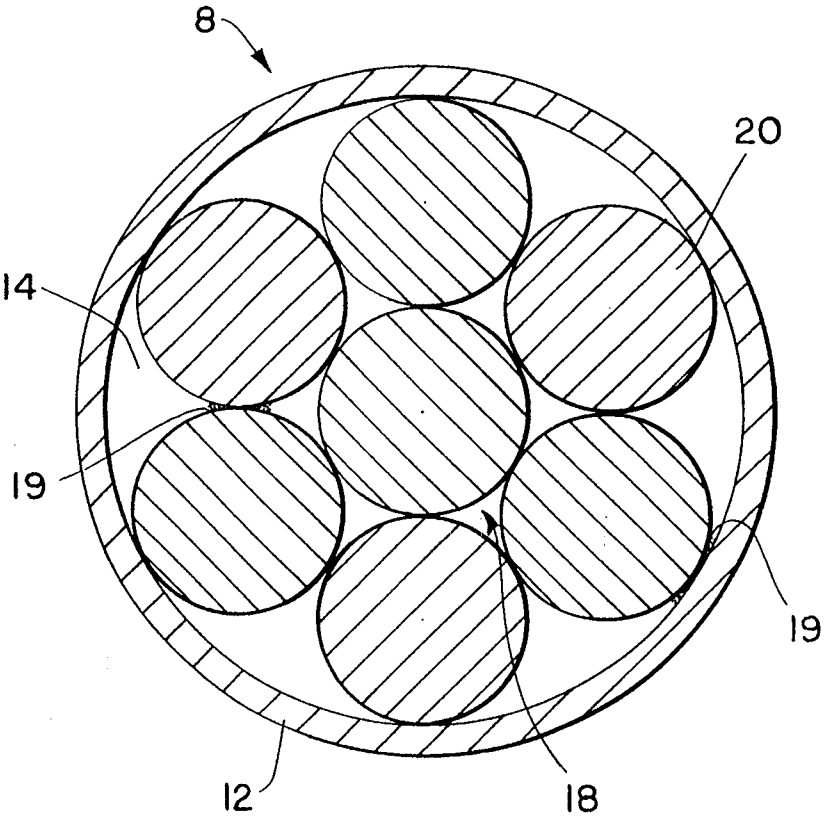
FIG. 3 is a schematic plan elevation of the embodiment of a casing and flechettes contained therein according to the invention shown in FIG. 1.
Figure 2:
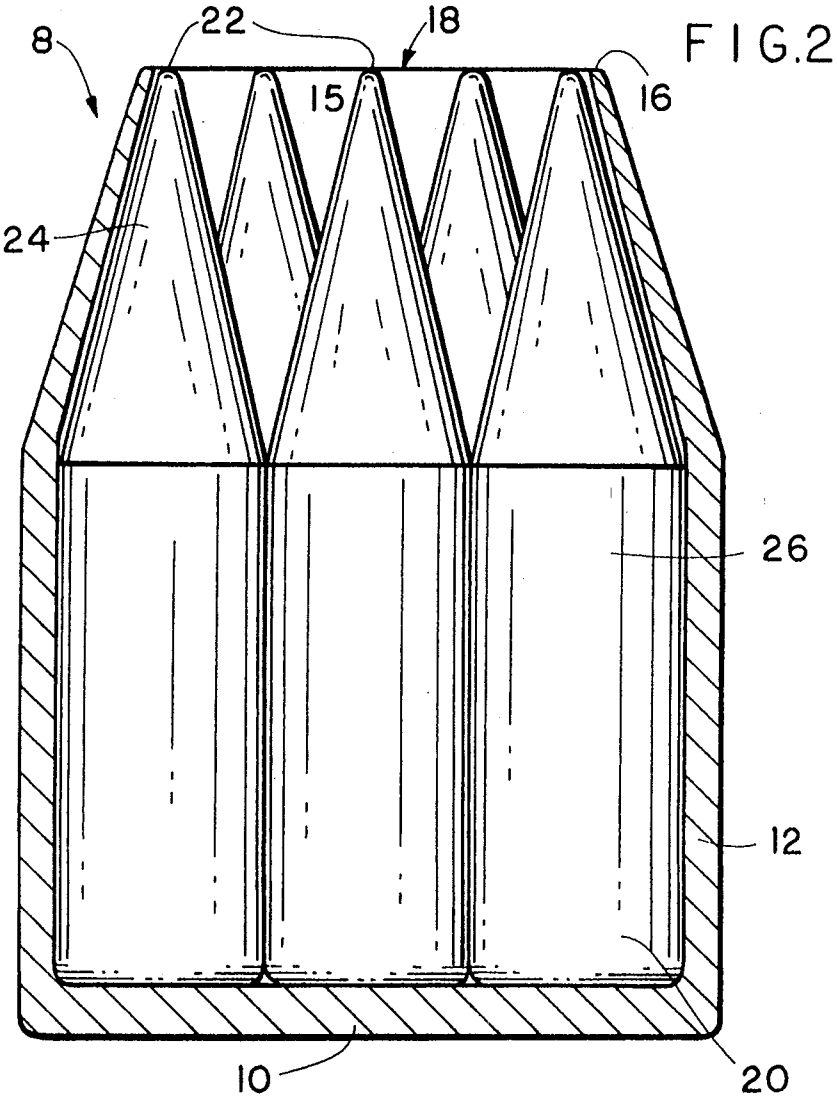
FIG. 2 is a side elevation cross-sectional view of an embodiment of the casing and flechettes according to the invention.

Referring to FIGS. 2 or 3, the casing 8 in this particular embodiment comprises a circular base region 10 and cylindrical region 12 is tapered towards a front tip 16 which is circular and defines the annular open nose 18 to the casing 8. The open nose 18 has a smaller diameter than cylindrical region 12 due to the tapering of the casing 8 which forms a ballistic ogive which gives the bullet suitable aerodynamic qualities.

In this embodiment, seven flechettes 20 are housed within casing 8. As shown in FIG. 2, flechettes 20 may be described as darts, being elongate members which, in this particular example, are tapered to a tip 22 at one end. A substantial length of each flechette 20 comprises a cylindrical region 26, which is tapered to tip 22 producing a conical region 24. Each flechette 20 weighs approximately 0.39 gms. Each flechette is approximately 12.5 mm. long and has a base diameter of 2.67 mm. The tip of each flechette has a cross-section diameter of 0.4–0.6 mm. It is envisaged that, while only seven flechettes are shown in this particular example, any number of such dart-like members from two to several hundred could be used. Similarly, the flechettes may have various shapes, where it is envisaged that the primary requirement to serve their purpose is that the flechettes have a ratio of diameter to length (or width to length if not circular in cross section) less than 1. In the embodiment shown, the diameter to length ratio is approximately 0.215. It is also envisaged that the flechettes need not be solid objects as shown in the preferred embodiment, but may be hollow or comprise a variety of materials. In the preferred embodiment, the flechettes are made of solid steel. However, the flechettes may also be constructed of thermoplastic, thermoset, composite or ceramic materials. The preferred material for the casing is copper (but other metals or plastics may be employed).

In this embodiment, the flechettes 20 are arranged in an ordered fashion, such that three times the internal diameter of an individual flechette equals the diameter of casing cavity 14. Therefore, a very neat array of seven flechettes can be arranged within the casing 8. In this way, it is possible to insert the flechettes 20 into an open-ended casing to be retained therein without the use of any kind of adhesive or locking means between the individual flechettes 20 or between the flechettes 20 and casing. Thus, it is possible to avoid loss of flechettes 20 through the open nose 18. However, it is also possible to use adhesives 19, or other locking means to ensure that the flechettes do not fall out of the open nose 18 and adhesives such as epoxy resins, polyurethane lacquers or polyester glues may be used. In the preferred embodiment, a polyurethane lacquer is used to adhere the individual flechettes and casing to one another.

Closely packing the flechettes in the way shown in this example has the advantage of ensuring the tips of the flechettes align, and point towards the front of the casing. It is also noted that any adhesive used to secure the flechettes within the casing and to align them is sufficiently frangible so that upon impact with a target the individual flechettes are separable from one another.

The method of making a bullet to the preferred embodiment of the invention described here is to form a hollow cylindrical casing with a closed base at one end and an opening at the other end. The walls of the casing are then thinned near the open end of the cylinder to leave a cylinder with substantially parallel walls, the thickness of which tapers towards the open end. The flechettes can be easily inserted through the open end of the casing 8 into cavity 14, the flechettes being aligned in the preferred embodiment as shown in FIG. 1. The open end of the casing is then compressed to form a front tip 16 which defines the open nose 18 of reduced diameter compared to the main cylindrical region 12. The length of the flechettes 20 is such that their tips 22 do not protrude through the open nose 18. The front of the casing is relatively frangible so that on impact the casing itself fractures more easily releasing the individual flechettes.

Figure 4:
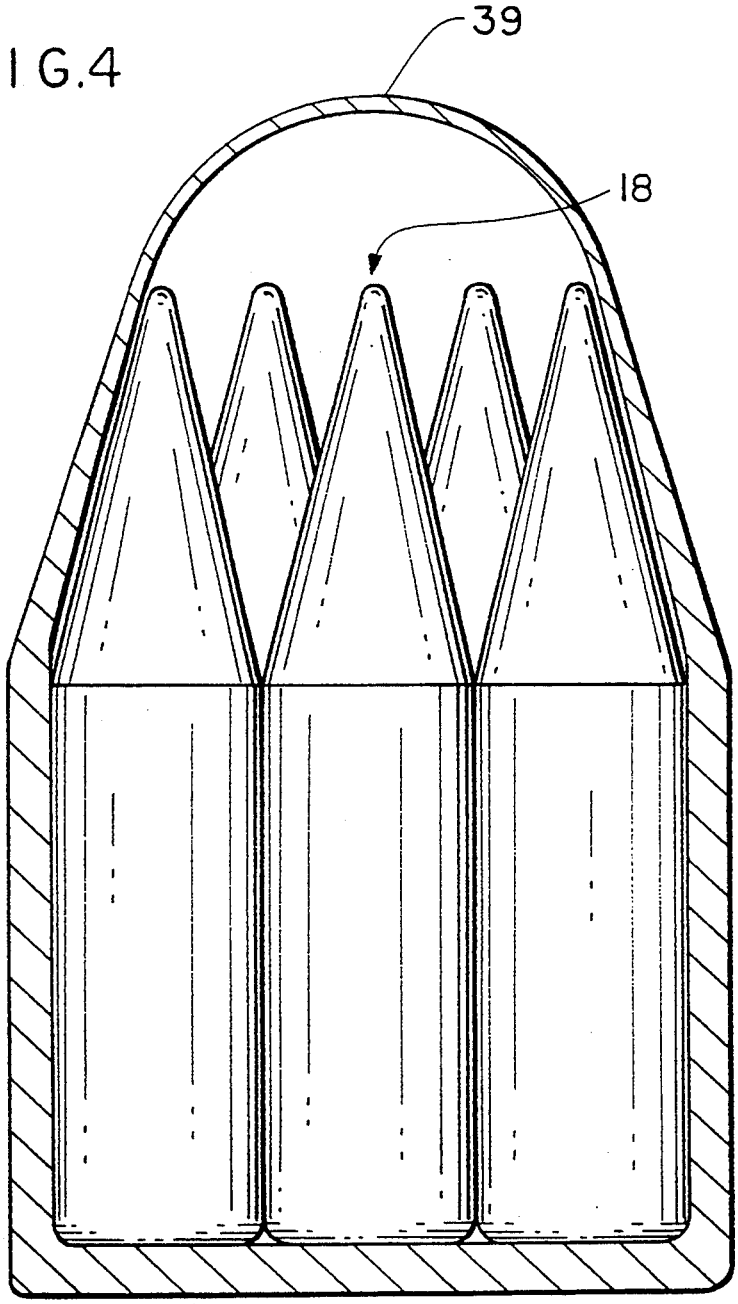
FIG. 4 is a schematic plan elevation of an embodiment of the invention wherein the front end of the casing is tapered to define a closed tip.

The frangible characteristic of the casing is enhanced by the open nose 18. However, as shown in FIG. 4, it is possible to make similar bullets according to the invention, whereby a closed end to the casing is used by suitably tapering the front end of the casing to a closed tip 39 or by putting a separable cap on open nose 18. It is also found that, while an open nose and thinned wall region at the front of the casing does provide a frangible casing which enables the flechettes to be readily released, an elastomeric nose cap can be used in cavity region 15 at the nose of the casing in order to prevent the casing 8 from collapsing inwardly when it strikes a very strong and flexible material such as a Kevlar ®. A suitable cap may be made from polyurethane which can be poured into the nose cavity 15 as a liquid and which can set to form a suitable nose cap. The preferred elastomeric nose cap has a durometer reading of 40/45.

It is found that the bullet according to the invention presents many desirable properties for a bullet used in law enforcement. The flechettes within the casing are able to penetrate strong material such as body armor but on penetration into a soft material, the individual flechettes spread out and do not pass all the way through the target body and are therefore unlikely to hit secondary items or people.

What is claimed is:

1. An ammunition round for penetrating armor comprising:

a cartridge containing a propellant charge;

a hollow cylindrical casing attached to said cartridge and constructed of frangible material which deforms upon impact with said armor, said casing having a first end which is closed and second end which tapers inwardly to define an annular open nose;

a plurality of flechettes housed in said casing, each said flechette having a tip pointing towards, but not protruding through, said annular open nose of said casing, said flechette having a width to length ratio of less than one and an unstable spin;

an elastomeric nose cap filling said annular open nose of said second end for stabilizing said flechettes while in said casing during flight and for creating an internal hydrodynamic pressure within said casing upon impact to prevent said casing from collapsing inwardly when said casing strikes the armor, to ensure the proper release and penetration of said flechettes into the armor; and wherein, during penetration of the armor by the flechette, the armor exerts a force on the shank of the flechette to prevent tumbling of the flechette.

2. An ammunition round according to claim 1, further comprising an adhesive within said casing for adhering said flechettes to said casing and to one another, said adhesive being sufficiently frangible so that upon impact with the armor said flechettes are separable from one another.

3. An ammunition round according to claim 2, wherein said casing has a wall thickness which decreases near said annular open nose end so that it will fracture more easily upon impact with the armor and thus ensure proper release of said flechettes.

4. An ammunition round according to claim 3, wherein seven cylindrical flechettes, each having a diameter which is one-third the internal diameter of said casing are disposed in said casing.

5. An ammunition round according to claim 1 wherein the flechettes are of substantially equal size.

6. An ammunition round for penetrating armor comprising:

a cartridge containing a propellant charge;

a hollow cylindrical casing attached to said cartridge and constructed of frangible metal which deforms upon impact with the armor, said casing having a first end which is closed and a second end which is hollow, tapered and closed to define a hollow tip;

a plurality of flechettes housed in said casing, each said flechette extending into said second end and having a tip pointing towards, but not protruding through, said hollow tip of said casing, said flechette having a width to length ratio of less than one and an unstable spin; and wherein, said flechette penetrates the armor and during penetration the armor exerts a force on the shank of the flechette to prevent tumbling of the flechette.

7. An ammunition round according to claim 6, further comprising an adhesive within said casing for adhering said flechettes to said casing and to one another, said adhesive being sufficiently frangible so that upon impact with the armor said flechettes are separable from one another.

8. An ammunition round according to claim 7, wherein said casing has a wall thickness which decreases near said hollow tip of said casing so that it will fracture more easily upon impact with the armor and thus ensure proper release of said flechettes.

9. An ammunition round according to claim 8, wherein seven cylindrical flechettes, each having a diameter which is one-third the internal diameter of said cylindrical casing are disposed in said casing.

10. An ammunition round for penetrating woven-type body armor comprising:

a cartridge containing a propellant charge;

a hollow cylindrical casing attached to said cartridge and constructed of frangible material which deforms upon impact with said armor, said casing having a first end which is closed and second end which tapers inwardly to define an annular open nose;

a plurality of flechettes housed in said casing, each said flechette having a tip pointing towards, but not protruding through, said annular open nose of said casing, said flechette having a width to length ratio of less than one and an unstable spin; and an elastomeric nose cap filling said annular open nose of said second end for stabilizing said flechettes while in said casing during flight and for creating an internal hydrodynamic pressure within said casing upon impact to prevent said casing from collapsing inwardly when said casing strikes the armor, to ensure the proper release of said flechettes between the weaves of the armor.

11. An ammunition round according to claim 10 wherein seven cylindrical flechettes, each having a diameter which is one-third the internal diameter of said cylindrical casing, are disposed in said casing.

12. An ammunition round for penetrating woven-type body armor comprising:

a cartridge containing a propellant charge;

a hollow cylindrical casing attached to said cartridge and constructed of frangible material which deforms upon impact with said armor, said casing having a first end which is closed and a second end which tapers inwardly to define an annular open nose and having a wall thickness which decreases near said annular open nose end so that it will fracture more easily upon impact with the armor;

a plurality of flechettes housed in said casing, each said flechette having a tip pointing towards, but not protruding through, said annular open nose of said casing, said flechette having a base diameter of about to 2.67 mm and a width to length ratio of less than about 0.25 and an unstable spin; and an elastomeric nose cap filling said annular open nose of said second end for stabilizing said flechettes while in said casing during flight and for creating an internal hydrodynamic pressure within said casing upon impact to prevent said casing from collapsing inwardly when said casing strikes the armor, to ensure the proper release of said flechettes between the weaves of the armor.

* * * * *